United States Patent [19]

Shiroyama

[11] Patent Number: 4,518,109

[45] Date of Patent: May 21, 1985

[54] MAGAZINE DEVICE OF AIR NAILER

[75] Inventor: Tadayoshi Shiroyama, Honmachi Uenoshi, Japan

[73] Assignee: Tachikawa Pin Seisakujo Co., Ltd., Japan

[21] Appl. No.: 508,014

[22] Filed: Jun. 27, 1983

[30] Foreign Application Priority Data

Feb. 2, 1983 [JP] Japan ..... 58-14270[U]

[51] Int. Cl.[3] ..... B25C 5/02; B25C 5/06; B25C 1/04

[52] U.S. Cl. ..... 227/109; 227/120; 227/130

[58] Field of Search ..... 227/109, 120, 130

[56] References Cited

U.S. PATENT DOCUMENTS 3,330,462 7/1967 Colechia et al. ..... 227/109
3,568,908 3/1971 Bader ..... 227/109 X
3,688,966 9/1972 Perkins et al. ..... 227/109 X

FOREIGN PATENT DOCUMENTS 51810 12/1982 Japan .

*Primary Examiner*—Paul A. Bell
*Assistant Examiner*—Taylor J. Ross
*Attorney, Agent, or Firm*—Lucas & Just

[57] ABSTRACT

A magazine device of an air nailer is disclosed. A support shaft for supporting a coil nail is formed by fitting concentrically a guide post having an outer diameter corresponding to the winding diameter of the coil nail, an adjust post inside the guide post and a tension post inside the adjust post so that the guide post outside the adjust post, that is fixed to the bottom of a case cover, is rotatable with respect to the adjust post and the tension post inside the adjust post is also rotatable with respect to the latter. While the support shaft is under the fitting stage, a guide pin is inserted through the support shaft in its radial direction. The adjust post is moved in the circumferential direction while the guide pin is engaged with several receiving stages having different heights and along with this movement, the guide post as well as a nail bracket are rotated and can extend or retract with respect to the adjust post. The tension post permits the movement of the guide pin in the axial direction of the support shaft. A tension spring is interposed between the tension post and the case cover in such a manner that the rewinding force acts upon the tension post, and always engages the guide pin with the receiving stage of a guide window hole.

1 Claim, 4 Drawing Figures

MAGAZINE DEVICE OF AIR NAILER

BACKGROUND OF THE INVENTION

This invention relates to a magazine device of an air nailer for storing several kinds of coil nails having different lengths in a single magazine so that the nails can be used by use of the single magazine.

The coil nail is produced by connecting one by one a large number of nails in the belt form with a predetermined gap between them by thin wires or synthetic resin plates and then winding helically the group of nails with a predetermined winding diameter.

A magazine device, which is means for using several kinds of nails having different lengths by use of a single magazine, is known from Japanese Utility Model Publication No. 51810/1982, for example. In this prior art device, an adjust plate is fitted to a support shaft projecting from the bottom surface of a magazine case in such a manner that the plate can slide up and down, and the winding diameter portion or bobbin of the coil nail is fitted to the support shaft so that the tips of the nails are supported by the support shaft. A plurality of protuberances are formed around the periphery of the adjust plate and fit holes to mate with these protuberances are locally defined around the inner circumferential wall of the magazine case of the magazine device. Several protuberance-receiving stages having different heights are disposed in the fit holes. According to this construction, the gap between the adjust plate and the cover of the magazine case can be made maximal when the protuberance of the adjust plate is engaged with the lowest receiving stage among the protuberance receiving stages, so that the coil nail of the longest nail can be stored. Similarly, the coil nail of the shortest nail can be stored by engaging the protuberance with the highest protuberance-receiving stage. As described above, when the adjust plate of the magazine case equipped with such an adjust plate is moved up and down, the optimal space for storing the nail can be defined and the coil nail can be stably stored while keeping its shape.

In order to adjust the height of the adjust plate, however, the operator of the device must manually carry out the following two kinds of works. First, he must pull up or push down the adjust plate to a desired height in the axial direction. Second, he must rotate the protuberance so as to engage it with the protuberance-receiving stage. After this engagement is established, he must also confirm the lock. For, if the lock is not sufficient, the protuberance is likely to disengage from the receiving stage during use of the air nailer when any external force acts upon the magazine case. If the state of engagement between the protuberance and the receiving stage is arbitrarily moved from the set position as described above, the spiral form of the coil nail inside the magazine case undergoes deformation so that the feed of nails is impeded.

SUMMARY OF THE INVENTION

It is therefore an object of the present invention to provide a magazine device of an air nailer in which a nail bracket which receives a coil nail inside a magazine case and can be vertically adjusted in accordance with the length of the nails can be reliably kept at a predetermined position and a guide pin supporting the nail bracket is prevented from disengaging from a receiving stage of a fitting hole even if any external impact is applied to the magazine case, in order to eliminate deformation of the coil nail and to ensure the smooth nail feed.

To accomplish the object described above, a support shaft for supporting the coil nail in the present invention has the following construction. A guide post having an outer diameter corresponding to the winding diameter of the coil nail, an adjust post inside the guide post and a tension post inside the adjust post are concentrically disposed so that the guide post outside the adjust post is rotatable with respect to the latter and the tension post inside the adjust post is rotatable with respect to the latter, respectively. While these posts that form the support shaft and are fitted concentrially are being fitted, a guide pin is inserted through the support shaft thus assembled in the radial direction. A guide window hole for the guide pin is defined on the outer circumference of the adjust post fixed to the bottom of the case cover in the circumferential direction and an elongated guide hole for the guide pin is defined on the tension post in the axial direction. The guide post and a nail bracket are allowed to move up and down in the axial direction of the tension post while being guided by the guide pin that moves inside the guide window hole and the guide hole and can also rotate along the circumference of the adjust post. A tension spring is interposed between the tension post and the bottom of the cover so that its rewinding force acts upon the tension post and always engages resiliently the guide pin with a receiving stage of the guide window hole.

DESCRIPTION OF THE PREFERRED EMBODIMENT

Hereinafter, a preferred embodiment of the present invention will be described in detail with reference to the accompanying drawings.

Figure 1:
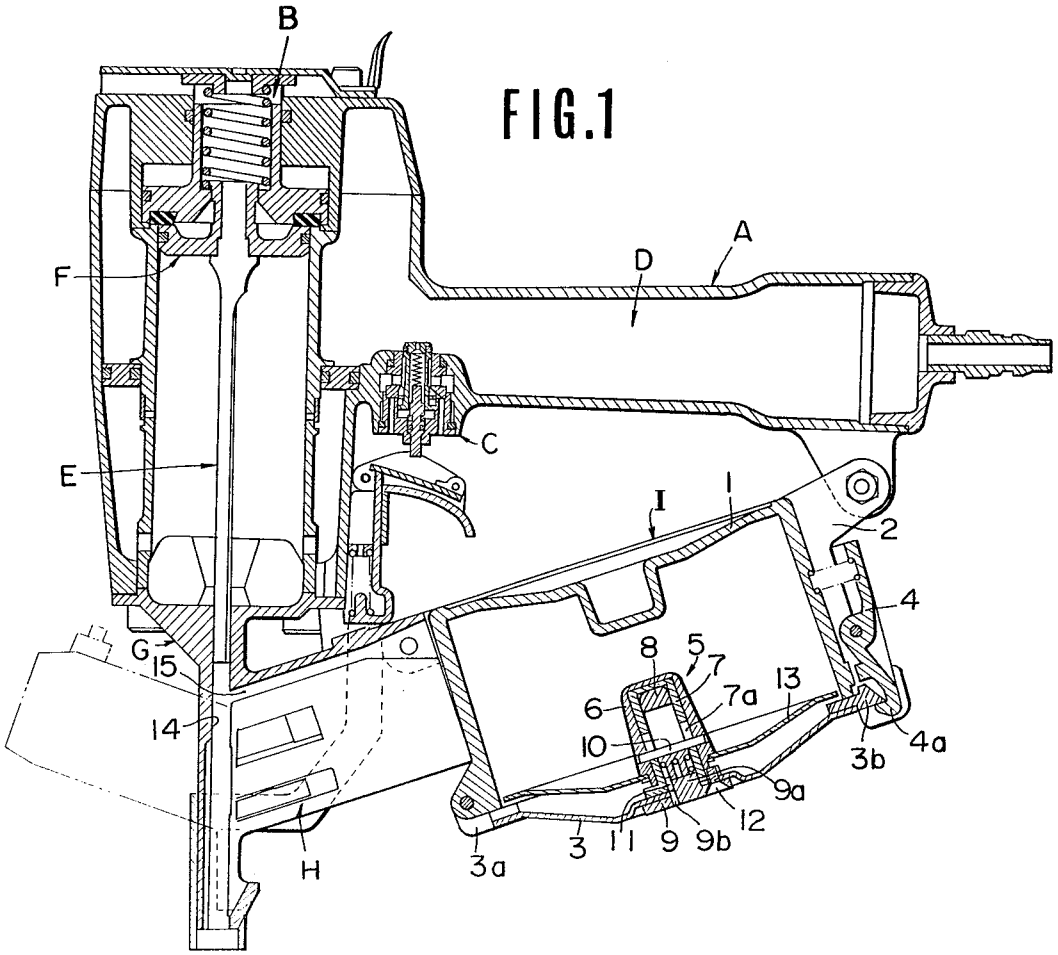
FIG. 1 is a longitudinal sectional view of the air nailer as a whole in the longitudinal direction.

FIG. 1 is a longitudinal sectional view of the air nailer at its center in its longitudinal direction. Symbol A represents the body of the air nailer; B is a head valve; C is a trigger valve disposed in the communication passage between the head valve and an air chamber D; E is a nailing driver; F is a driver piston; and G is a guide nose. As is known, the guide nose G is equipped with a nail feeder H which can advance a nail of a predetermined size into a driver groove 14. Reference numeral 15 represents a nail guide passage.

Symbol I represents a magazine unit and reference numeral 1 represents a downwardly open magazine case as one of the constituents of the magazine unit. The magazine case 1 is fitted to the body A by an outwardly projecting fitting plate 2. Reference numeral 3 represents a magazine cover as another constituent of the magazine unit and this cover 3 is turnably connected to the magazine case 1 via a hinge 3*a* and opens or closes the nail loading port of the case. Reference numeral 3*b* represents a stopper piece disposed at one of the ends of the magazine cover 3 and reference numeral 4 represents a stop lever of the magazine cover 3. This is of a lever type and a pawl 4*a* at its lower end engages and disengages the stopper piece 3*b*, thereby functioning as lock means of the magazine cover 3.

Figure 2:
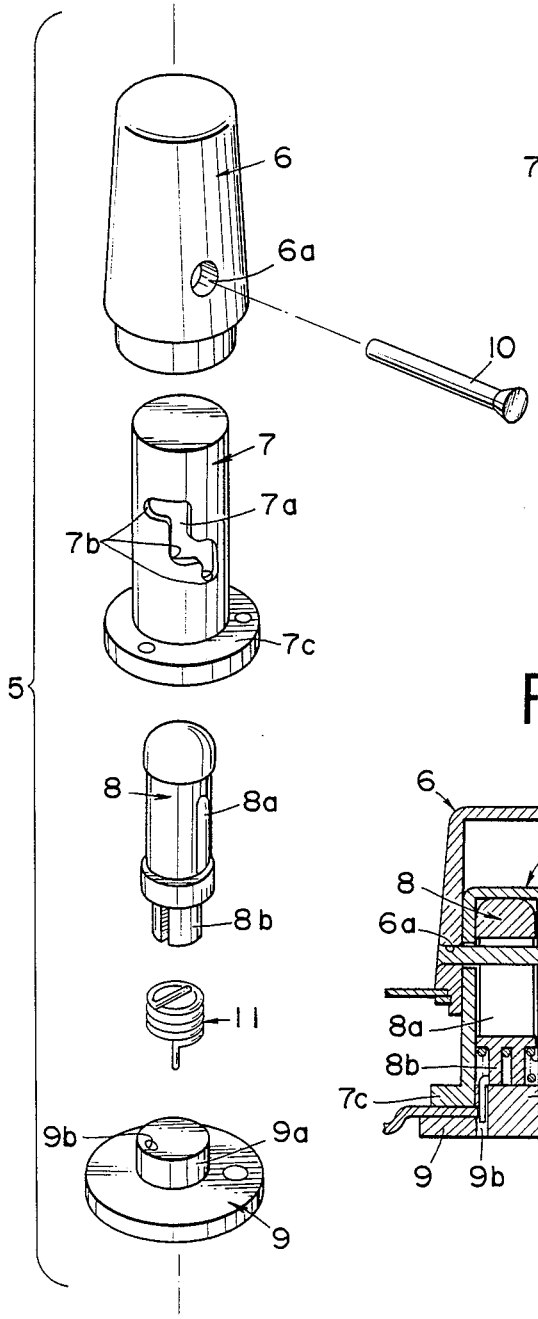
FIG. 2 is an exploded perspective view of constituents of the support shaft.
Figure 3:
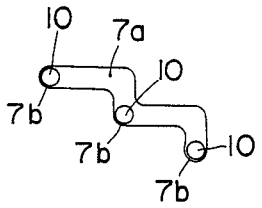
FIG. 3 is a view of the guide window hole under the state where the guide pin step-wise engages with the receiving stages of the guide window hole.
Figure 4:
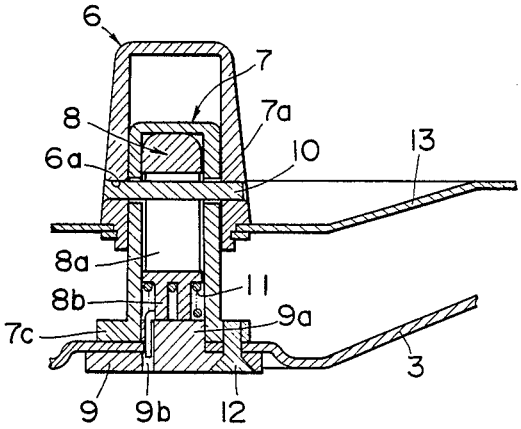
FIG. 4 is a partial sectional view of the support shaft when the guide pin is set to the highest position of the guide stage.

Reference numeral 5 represents a support shaft of a coil nail. As shown in an exploded perspective view of FIG. 2, the support shaft consists of a guide post 6, an adjust bolt 7, a tension post 8, a post holder 9, a nail bracket 13, a guide pin 10, and so forth and is assembled in the following way. The adjust post 7 is fitted into the inner diameter portion of the guide post 6 which has an outer diameter corresponding to the bobbin diameter of the coil nail, and the tension post 8 is fitted into the inner diameter portion of the adjust post 7 in concentric arrangement with the adjust post 7. The guide post 6 is equipped with fitting holes 6a for fitting and fixing the guide pins around its outer circumference at the ends in its radial direction. Guide window holes 7*a* are disposed symmetrically around the circumference of the adjust post 7 so as to guide the guide pin that passes through the post in the radial direction. Several kinds of receiving stages 7*b* and having different heights are disposed along the lower edge of the fitting holes. A guide hole 8*a*, elongated in the axial direction, is formed on the outer circumference of the tension post at the height corresponding to the range of the height of the guide window holes 7*a* of the adjust post 7. After the three members described above are fitted, the guide pin 10 is passed through each hole and is fixed to the guide post.

A reduced diameter portion 8*b* is formed at the lower end of the tension post 8 and a multiple winding tension spring 11 is fitted to this reduced diameter portion 8*b*. The lower end of this spring 11 is fixed to the post holder 9 or to the bottom of the case cover, as will be described elsewhere. The dish-like nail bracket 13 is fixed to and integrated with the lower end surface of the guide post 6 before the three members described above are fitted. The post holder 9 is fitted into the center hole of the magazine cover 3 so that the reduced diameter portion 9*a* projects towards the support shaft. A small hole 9*b* is bored on the upper surface of the small diameter portion 9*a*. The post holder 9 is fixed by a screw 12 to the bottom of the magazine cover 3 together with a flange 7*c* of the adjust post 7. The small diameter portion 9*a* of the post holder 9 is fitted and fixed to the lower end inner diameter portion of the adjust post 7 and the tension spring 11 is wound on the post 7 so that the spring generates the rewinding force. The lower end of the spring 11 is compulsively fitted and fixed to the small hole 9*b* of the post holder 9. Accordingly, the tension post 8 is always urged by the rewinding force of the tension spring 11 and applies the urging force to the guide post 10 which penetrates through the post 8. Due to this urging force, the guide post 6 is brought into pressure contact with the receiving stages 7*b* of the adjust post 7 at its guide window hole 7*a*, thereby establish firm engagement.

As is obvious from the assembly structure described above, the support shaft 5 of the coil nail positioned at the lowermost stage can be moved to a higher stage in the following manner. First, the guide post 6 is picked up by a predetermined distance from the tension post 8 and from the adjust post 7.

In this instance, since predetermined urging force always acts upon the tension post 8 as described above, the guide post and the nail bracket automatically rotate with the guide pin 10, are brought into pressure contact with the next receiving stage 7*b* of the guide window hole 7*a*, and are set there. On the contrary, the support shaft 5 of the coil nail positioned at the uppermost stage can be lowered in the following manner. The operator forcedly rotates the guide post 6 against the tension post 8 and pushes it down, whereupon the urging force acting upon the tension post sequentially brings the guide post 6 into pressure contact with the next receiving stage 7*b*, where the guide post 6 is reliably held in place.

As described in the foregoing, in the coil nailer of the present invention, the tension spring is disposed on the tension post which is disposed at the center of the support shaft of the coil nail so that this spring force acts upon the guide pin and the guide pin always comes into pressure contact and engages with the receiving stage of the guide window hole of the adjust post. This arrangement lets the guide post as well as the nail bracket keep the positions of the set height and they can be reliably held at those positions. To adjust the support shaft, especially to move it up from a low position, the guide post is merely picked up in the axial direction so that the guide post and the nail bracket rotate automatically and engage with the receiving stage. Hence, handling can be made easily and simply.

What is claimed is:

1. A magazine device of an air nailer characterized in that a magazine cover is fitted to a magazine case fixed to the body of the air nailer and capable of storing a coil nail in such a manner that said magazine cover can open and close a loading port for said coil nail; a support shaft is formed by fitting sequentially and concentrically a guide post having an outer diameter corresponding to a winding diameter of said coil nail, an adjust post inside said guide post and a tension post inside said adjust post to the center of the bottom of said magazine cover and integrally fixing a dish-like nail bracket for receiving the tips of nails of said coil nail to the lower end surface of said guide post with said guide post being at the center of said nail bracket; a guide pin is inserted through said support shaft in the radial direction with the right and left ends of said pin being fixed to said guide post; the lower end of said adjust post is fixed to the bottom of said magazine cover; guide window holes for said guide pin and receiving stages having sequentially varying heights are step-wise defined around the outer circumference of said adjust post so as to engage with said guide pin; said guide post, guided by said guide pin, can extend or contract whole being rotated outside said adjust pin; a guide for said guide pin is defined in the intermediate portion on the outer circumference of said tension post and passes through said tension post in radial direction, to extend over a predetermined length in the axial direction of said tension post and to allow the movement of said guide post guided by said guide pin in the axial direction of said support shaft; said tension post is supported by a tension spring interposed between the lower end surface of said tension post and the bottom of said magazine cover; and the upper and lower ends of said tension spring are wound and fixed to the bottom of said magazine cover and to said tension post so that said guide pin receiving the rewinding force of said tension spring always engages resiliently with said receiving stage of said guide window hole.

* * * * *